US005683205A

United States Patent [19]

Halkyard

[11] Patent Number: 5,683,205

[45] Date of Patent: Nov. 4, 1997

[54] STRESS RELIEVING JOINT FOR PIPE AND METHOD

[75] Inventor: John Edwin Halkyard, Poway, Calif.

[73] Assignee: Deep Oil Technology, Inc., Irvine, Calif.

[21] Appl. No.: 431,147

[22] Filed: Apr. 28, 1995

[51] Int. Cl.[6] ..... F16B 1/00

[52] U.S. Cl. ..... 405/224.2; 403/41

[58] Field of Search ..... 405/224, 224.1, 405/224.2, 224.3; 285/223, 263; 403/41

[56] References Cited

U.S. PATENT DOCUMENTS 4,185,694 1/1980 Horton ..... 166/350
4,740,109 4/1988 Horton ..... 405/224.2

*Primary Examiner*—Tamara L. Graysay
*Assistant Examiner*—Tara L. Mayo
*Attorney, Agent, or Firm*—Oppenheimer Poms Smith

[57] ABSTRACT

A stress relieving joint for pipe such as risers, tendons, and the like used in floating vessel systems wherein a vessel is subject to heave, pitch, and roll motion caused by wind, currents, and wave action; the pipe passing through a constraint opening in the vessel and connected to the sea floor and subject to bending or rotation at the constraint opening. The joint comprises a sleeve member of selected length with ends at opposite sides of the constraint opening and centralizing annuli or rings at sleeve member ends for providing spaced contact points or areas to distribute bending stresses imparted to the sleeve member at the constraint opening to the pipe at the sleeve member ends. A method of relieving or distributing stress in a pipe at a constraint location.

28 Claims, 2 Drawing Sheets

STRESS RELIEVING JOINT FOR PIPE AND METHOD

BACKGROUND OF THE INVENTION

The development of deep water oil operations from floating vessels has included the use of tendons and risers under tension extending from the vessel to the sea floor. Such floating vessels have included tension buoyant towers, compliant towers, and spars in which the structures extend well below the sea surface and are subjected to heave, pitch, and roll motion. The tendons and risers are connected to the sea floor and pass through openings in the keel or bottom portion of the vessels. The openings constrain the pipe forming the tendons or risers when the vessel is moved laterally with respect to the sea floor connection. Such lateral movement produces bending of the pipe at the constraint opening or rotation of the pipe about the contact of the pipe with the edges of the opening. Bending of the pipe which is normally under tension results in fatique and wear at the constraint opening.

Prior proposed means for controlling stress at such a point or area of rotation of the pipe have included tapered pipe wall sections of very large wall thickness. The thick tapered wall sections are usually machined from heavy forgings and are very expensive.

Another prior proposed joint means for a mud line or sea floor connection included a hole in the sea floor to receive a pipe end, a sleeve member centralized within the opening, the pipe end portion within the sleeve member not being connected to the sleeve member.

Another somewhat similar joint means included a pipe end portion received within the hole in the sea floor and centralized in said opening by a ring means located between the side walls of the opening and the pipe end portion.

The present invention distributes bending stress normally localized at the pipe portion at the constraint opening to spaced areas of the pipe portion at selected distances on opposite sides of the opening.

SUMMARY OF INVENTION.

The present invention relates to a novel stress relieving joint means for pipe used as tendons, risers or the like with floating vessels for deep sea oil operations.

The present invention particularly contemplates a sleeve member ensleeved over a pipe portion adjacent to a constraint opening in the keel of a vessel whereby edges of the opening may contact the sleeve member between its ends to distribute bending stresses imposed on the sleeve member to spaced points on the pipe at opposite sides of the constraint opening.

The invention also contemplates the use of such a sleeve member at the mud line or sea floor connection of the pipe when lateral horizontal excursion of the vessel imposes large bending stresses at the sea floor connection.

An object of the invention is to provide a stress joint comprising a sleeve member having annuli or rings at each open end for engagement with the pipe portion passing through the sleeve member.

Another object of the invention is to provide a joint means on a pipe portion for distributing bending stresses to spaced points or areas on the pipe portion.

A further object of the invention is to provide a joint means including a sleeve member having elastomeric annuli for engagement with a pipe portion.

Still another object of the invention is to provide a protective coating and or wear means for the sleeve member of the joint described above upon contact with edges of the constraint opening.

A further object of the invention is to provide a joint means including a sleeve member of greater inner diameter than the outer diameter of the pipe at its end connection, one end of the sleeve member having a mechanical connection to the pipe portion and the other end of the sleeve member being sleeved over a spacing ring connected to the pipe portion.

The invention further contemplates a novel method of distributing bending stresses in a tensioned pipe subject to lateral horizontal excursions of a floating vessel by sleeving a cylindrical member over the pipe portion at a constraint opening and centralizing the pipe portion within the sleeve member by ring means at opposite ends of the sleeve member and spaced from the opening.

Other objects and advantages of the present invention will be readily apparent to those skilled in the art from following description of the drawings in which exemplary embodiments of the invention are shown.

IN THE DRAWINGS

DETAILED DESCRIPTION.

Figure 1:
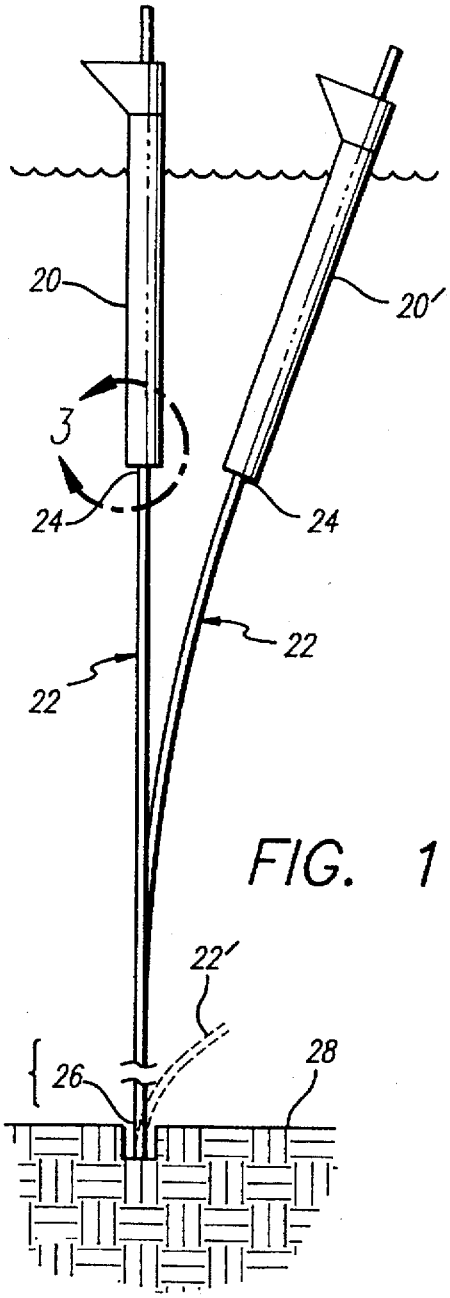
FIG. 1 is a schematic view of a floating vessel, sea floor, and pipe interconnecting the vessel and sea floor.

FIG. 1 generally and schematically shows a vessel 20 of spar, tension buoyant tower, or compliant tower type with a pipe 22 exiting from its bottom or keel at 24 and having a suitable connection at 26 to the sea floor 28. Lateral horizontal excursion of vessel 20 is indicated by its position at 20'. Bending stresses occur on the pipe where it exits at 24 at the keel and at sea floor connection at 26,the dotted lines 22' exaggerating such bending.

Figure 2:
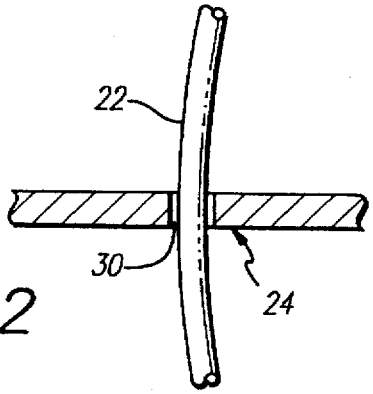
FIG. 2 PRIOR ART
FIG. 2 is a fragmentary schematic view of the pipe at the keel opening of the vessel without the joint means of the present invention.

FIG. 2 schematically indicates curvature of pipe 22 adjacent the keel opening 30. The joint at the keel opening is non-tapered. A high bending stress in the pipe results at the constraining keel opening 30 and is highly sensitive to the tension in the pipe.

Figure 3:
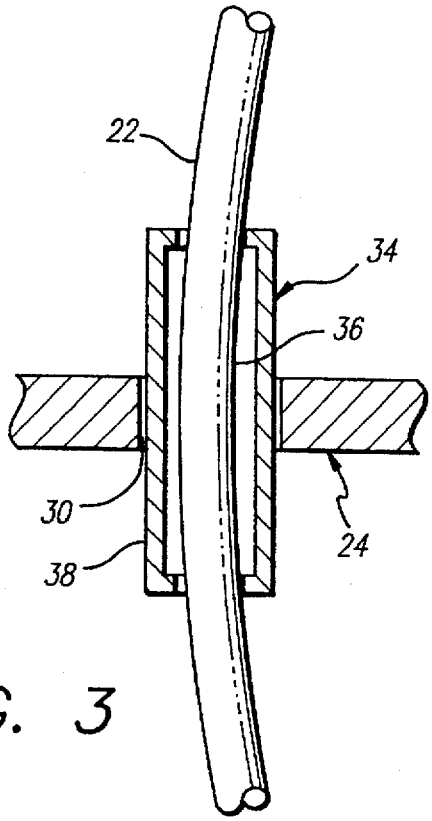
FIG. 3 is a schematic view of the encircled portion of FIG. 1 showing the keel opening provided with the joint means of this invention.

FIG. 3 schematically shows a joint means 34 of this invention at keel opening 30 with pipe portion 36 passing through the sleeve member 38 which is positioned in the keel opening 30.

Figure 4:
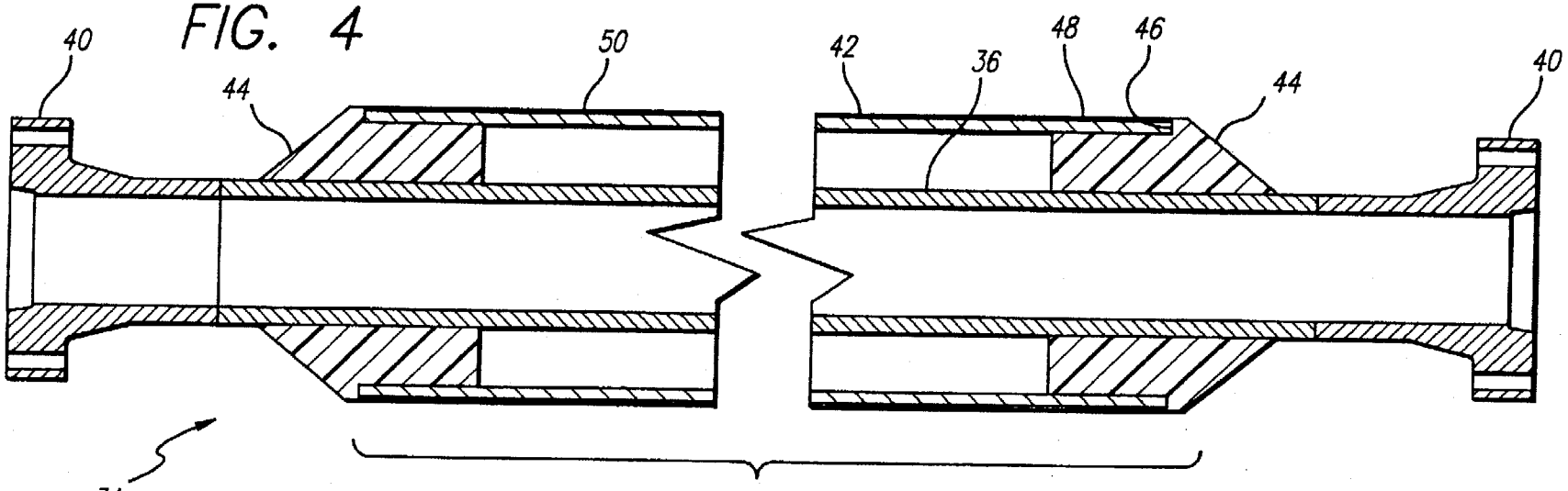
FIG. 4 is a sectional view of a joint means embodying this invention, the section being taken along the longitudinal axis of the joint means, the length being foreshortened.

One exemplary embodiment of the joint means 34 is shown in detail in FIG. 4. Pipe portion 36 may be provided with flanged joint ends 40 for connection to pipe 22. Ensleeved over pipe portion 36 is a sleeve member 42 which may be of steel and having an inner diameter greater than the outer diameter of the pipe portion 36.

At each end of the sleeve member 42 an annulus or ring 44 connects the end of member 42 with the outer surface of the adjacent pipe portion 36. In this example annulus 44 may be made of an elastomeric material bonded to the outer surface of pipe portion 36 and to sleeve member 42. The outer cylindrical surface of annulus 44 may be provided with a shoulder 46 to seat end 48 of sleeve member 42. The outer surface of the member 42 may be provided with a protective coating 50 to resist wear caused by relative movement of the sleeve member and pipe within the constraint opening 30. It will be understood that at the points of contact of the outer surface of member 42 with the keel opening metallic or non-metallic wear pads may be affixed to the outer surface of member 42. The thickness of the wall of sleeve member 42 may also be designed with a wear allowance.

Annulus 44 of elastomeric material provides a resilient somewhat yieldable connection to the sleeve member which serves to reduce contact and impact stresses between the sleeve member and pipe portion and allows rotation while avoiding any concentrated points of contact therebetween.

Design parameters for the joint means of this invention include the thickness of sleeve member 42, the diameter and thickness of cylindrical sleeve member 42 and the length of the sleeve member. In the example in FIG. 4 the length of the sleeve may be 47 feet, the outer diameter of the pipe 36 about 10.75 inches, the inner diameter of the sleeve about 22 inches, and the outer diameter of the sleeve, 24 inches.

Figure 5:
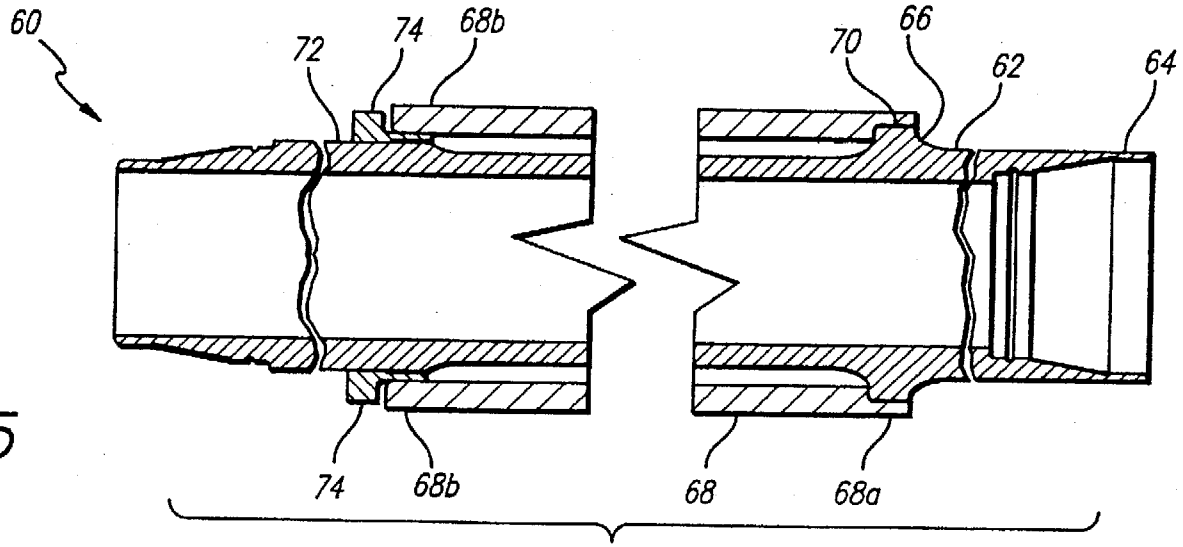
FIG. 5 is a longitudinal sectional view of another example of this invention in which the the joint means is without elastomeric connection to the pipe.

In the embodiment of this invention shown in FIG. 5 a joint means generally indicated at 60 includes a tensioned pipe portion 62 having coupling ends 64 for connection to a riser pipe, tendon, or the like. At one end of portion 62, an annular upset or shoulder 66 is provided with external threads for a threaded connection to internal threads on one end 68*a* of sleeve member 68 as at 70.

The opposite end 68*b* of member 68 is plain and receives between it and an enlarged section 72 on portion 62 a shouldered ring 74 threaded on section 72 and serves to maintain centralization of the pipe portion 62 within sleeve member 68.

In addition to centralization of pipe portion 62 in plain end 68*b* a loose fit is provided between end 68*b* and shouldered ring 74. Some relative rotational movement about the longitudinal axis of pipe portion 62 as well as some relative axial movement between end 68*b* and tensioned pipe portion 62 is afforded by the loose fit at end 68*b*.

In this example the wall thickness of member 68 is shown as greater than the corresponding wall thickness of member 42,as may be required in deep water operations with higher tension forces on the pipe.

Figure 6:
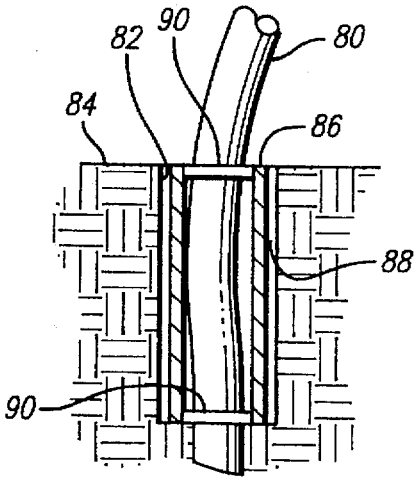
FIG. 6 is a schematic view of a joint means of this invention used at a sea floor connection of a tensioned riser or tendon pipe.

In FIG. 6 an example of this invention is shown as used in a sea floor connection. A tendon or riser pipe 80 is received within a well hole or bore 82 in the sea floor 84. In this example the sea floor stress relieving joint is received within hole 82 and comprises sleeve member 86 spaced at 88 from the walls of the well hole 82. Centralizer ring means 90 of steel or elastomeric material may be bonded or connected to the sleeve member 86 and to the pipe 80 in the manner shown in the embodiments of the invention described above. The upper end of the sleeve member 86 may be at the sea floor as shown. The sleeve member 86 may extend a selected distance into well hole 82 and may move with the pipe string relative to the well hole. In this example elastomeric centralizers seal the space between the pipe 80 and the sleeve member 86 and prevent debris or foreign material from entering this space.

As schematically shown in FIG. 6 hole 82 is a constraint opening which imparts bending stresses to the pipe 80 when the vessel moves laterally with respect to the sea floor connection. The bending stresses are imparted to the pipe 80 through the sleeve member and ring means 90 at spaced points or areas to distribute the bending stresses as in the prior examples.

It will be understood that the actual parameters of the joint means depend on several factors such as loading on the pipe, available pipe sizes, the opening through which the pipe passes, and the expected motion of the vessel to which one end of the pipe is connected by suitable means. An optimized joint means of this invention may provide for nearly equal total bending stresses in the tensioned inner pipe and the sleeve member.

It should be noted that the joint means of this invention provides an external sleeve member to receive bending stresses intermediate to its ends at the constraint opening and to distribute curvature resulting therefrom to spaced points or areas on the pipe at ends of the sleeve member. The sleeve members 42,68 are much stiffer than 10 the smaller diameter inner pipe. Each sleeve member 42,68,88 has a larger diameter and the thickness of its wall provides a stiffer member than the tensioned inner pipe to receive stresses at the constraint opening. It should also be noted that the sleeve members do not carry a tension load and its stresses are bending stresses.

It may be further noted that the sleeve member and its connecting means to the pipe serves to distribute stresses from a constraint opening of inner diameter larger than the outer diameter of the sleeve member, the sleeve member having an inner diameter greater than the pipe outer diameter, and further serves to centralize the pipe within the sleeve member. The pipe is allowed deflection within the sleeve member and between the ring means at opposite ends of the sleeve member.

It will be understood that various modification and changes may be made in the joint means described above and all such changes or modifications coming within the scope of the appended claims are embraced thereby.

I claim:

1. A stress relieving joint for use with pipe in floating systems wherein a vessel is subject to variable motion caused by wind, currents, and wave action, said pipe having one end connectable to the sea floor and an upper pipe portion adapted to pass through a constraining opening at the bottom of the vessel, the stress relieving joint comprising:

a sleeve member of selected length and diameter ensleeved over the pipe portion at the constraint opening and having an inner diameter greater than the outer diameter of the pipe portion; and means at opposite ends of the sleeve member centralizing the pipe within the sleeve member and located on opposite sides of the constraint opening such that a portion of the centralizing means is outside the vessel whereby bending stresses of the pipe portion at the constraint opening are relieved and distributed to the pipe at ends of the sleeve member.

2. A stress relieving joint for use with pipe in floating systems wherein a vessel is subject to variable motion caused by wind, currents, and wave action, said pipe having one end connectable to the sea floor and an upper pipe portion adapted to pass through a constraint opening at the bottom of the vessel, the stress relieving joint comprising:

a sleeve member of selected length and diameter ensleeved over the pipe portion at the constraint opening and having an inner diameter greater than the outer diameter of the pipe portion; and means, including an annulus of elastomeric material secured to opposite ends of the sleeve member and to the pipe portion at at least one sleeve member end, centralizing the pipe within the sleeve member and located on opposite sides of the constraint opening whereby bending stresses of the pipe portion at the constraint opening are relieved and distributed to the pipe at ends of the sleeve member.

3. A joint as claimed in claim 1 wherein said sleeve member includes a protecting coating on its outer surface for reducing wear contact with edges of the constraint opening.

4. A stress relieving joint for use with pipe in floating systems wherein a vessel is subject to variable motion caused by wind, currents, and wave action, said pipe having one end connectable to the sea floor and an upper pipe portion adapted to pass through a constraint opening at the bottom of the vessel, the stress relieving joint comprising:

a sleeve member of selected length and diameter ensleeved over the pipe portion at the constraint opening and having an inner diameter greater than the outer diameter of the pipe portion; and means at opposite ends of the sleeve member centralizing the pipe within the sleeve member, located on opposite sides of the constraint opening, and including an annular shoulder on said pipe portion receivable within one end of said sleeve member and a shouldered annular ring carried by the pipe portion for centralizing cooperation with the other end of the sleeve, whereby bending stresses of the pipe portion at the constraint opening are relieved and distributed to the pipe at ends of the sleeve member.

5. An apparatus for distributing in spaced relation stresses in a pipe at a constraint opening through which the pipe passes, the constraint opening defining a length and respective longitudinal ends, the apparatus comprising:

an open ended sleeve member of greater inner diameter than the outer diameter of the pipe, said sleeve member having a selected length greater than the length of the constraint opening for positioning each end of the sleeve member a selected distance from the constraint opening; and means connecting said sleeve member to the pipe for centralizing the pipe within the sleeve member and transmitting bending stresses imparted at the constraint opening through the sleeve member to the pipe at a contact point spaced from the constraint opening.

6. An apparatus as claimed in claim 5 said connecting means provides contact with the pipe at spaced points for distributing the bending stresses imparted to the sleeve member at the constraint opening to the pipe at said spaced points.

7. An apparatus as claimed in claim 5 wherein said centralizing means includes an annulus of metallic material at each end of the sleeve member.

8. An apparatus for distributing in spaced relation stresses in a pipe at a constraint opening through which the pipe passes, the apparatus comprising:

an open ended sleeve member of greater inner diameter than the outer diameter of the pipe, said sleeve member having a selected length for positioning each end of the member a selected distance on opposite sides of the opening; and means, including an annulus of elastomeric material at each end of the sleeve member, connecting said sleeve member to the pipe for centralizing the pipe within the sleeve member and transmitting bending stresses imparted at the constraint opening through the sleeve member to the pipe at a contact point spaced from the constraint opening.

9. A method of distributing stress in a pipe portion adjacent to a constraint opening defining a length where longitudinal edges of the opening normally contact the pipe and impose bending stresses thereon when a distal pipe end is moved laterally with respect to the opening, the method comprising the steps of:

sleeving a cylindrical member defining a greater length than the constraint opening over the pipe at the constraint opening for contact with edges of the opening at a central portion of the cylindrical member; and centralizing the pipe portion within the cylindrical member in spaced relation thereto by ring means located at opposite longitudinal ends of the cylindrical member, the longitudinal ends of the cylindrical member being spaced from the longitudinal edges of the constraint opening to distribute stresses through the cylindrical member to the pipe portion at spaced locations.

10. A floating system, comprising:

a floating vessel including a constraint opening;

a pipe including one end connectable to the sea floor and an upper pipe portion adapted to pass through the constraint opening, the upper pipe portion defining a pipe portion outer diameter and including an annular shoulder defining a diameter greater than the pipe portion outer diameter; and a stress relieving joint including a sleeve member ensleeved over the upper pipe portion at the constraint opening and connected to one end of the sleeve member, the sleeve member defining an inner diameter greater than the outer diameter of the pipe portion; and means at opposite ends of the sleeve member for centralizing the pipe within the sleeve member and located on opposite sides of the constraint opening;

whereby bending stresses of the upper pipe portion at the constraint opening are relieved and distributed to the upper pipe portion at ends of the sleeve member.

11. A floating system, comprising:

a floating vessel including a lower portion defining a constraint opening;

a pipe including one end connectable to a sea floor and an upper pipe portion adapted to pass through the constraint opening; and a stress relieving joint, including a sleeve member substantially surrounding a portion of the pipe and defining an inner surface and first and second ends located on opposite sides of the constraint opening such that the first end of the sleeve member is within the vessel and the second end of the sleeve member is outside the vessel, the inner surface of the sleeve member and the pipe defining a distance therebetween, and first and second centralizing members respectively associated with the first and second ends of the sleeve member, the first and second centralizing members being located substantially between the pipe and the inner surface of the sleeve member.

12. A floating system as claimed in claim 11, wherein at least one of the first and second centralizing members is substantially immovable with respect to the sleeve member.

13. A floating system as claimed in claim 12, wherein both of the first and second centralizing members are substantially immovable with respect to the sleeve member.

14. A floating system as claimed in claim 11, wherein the at least one of the first and second centralizing members is integral with the sleeve member.

15. A floating system as claimed in claim 11, wherein at least one of the first and second centralizing members comprises an annular member.

16. A floating system as claimed in claim 15, wherein the annular member is in contact with the pipe and the inner surface of the sleeve member.

17. A floating system as claimed in claim 15, wherein the annular member comprises an elastomeric material.

18. A stress relieving joint for use with a pipe that passes through an opening, the stress relieving joint comprising:

a sleeve member substantially surrounding a portion of the pipe and defining an inner surface and first and second ends, the inner surface of the sleeve and the pipe defining a distance therebetween, and first and second centralizing members respectively associated with the first and second ends of the sleeve member, the first and second centralizing members extending inwardly from the inner surface of the sleeve member and at least one of the first and second centralizing members being substantially immovable with respect to the sleeve member.

19. A stress relieving joint as claimed in claim 18, wherein the opening defines a longitudinal length and the sleeve member defines a longitudinal length greater than the longitudinal length of the opening.

20. A stress relieving joint as claimed in claim 18, wherein the at least one of the first and second centralizing members is integral with the sleeve member.

21. A stress relieving joint as claimed in claim 18, wherein at least one of the first and second centralizing members comprises an annular member.

22. A stress relieving joint as claimed in claim 21, wherein the annular member is in contact with the pipe and the inner surface of the sleeve member.

23. A stress relieving joint as claimed in claim 21, wherein the annular member comprises an elastomeric material.

24. A stress relieving joint as claimed in claim 18, wherein both of the first and second centralizing members are substantially immovable with respect to the sleeve member.

25. A stress relieving joint as claimed in claim 18, wherein the first and second ends of the sleeve member are located in spaced relation to opposite sides of the opening.

26. A floating system, comprising:

a floating vessel including a lower portion having a constraint opening defining an inner surface;

a pipe including one end connectable to a sea floor and an upper pipe portion adapted to pass through the constraint opening; and a stress relieving joint, including a sleeve member substantially surrounding a portion of the pipe and defining an inner surface, an outer surface and first and second ends, the inner surface of the constraint opening and the outer surface of the sleeve member defining a predetermined distance therebetween, and first and second centralizing members respectively associated with the first and second ends of the sleeve member, the first and second centralizing members being located substantially between the pipe and the inner surface of the sleeve member.

27. A floating system as claimed in claim 26, wherein the sleeve member and pipe are fixedly secured to one another.

28. A floating system as claimed in claim 27, wherein the sleeve member and pipe are fixedly secured to one another by at least one of the centralizing members.

* * * * *